US007066795B2

(12) United States Patent
Balagani et al.

(10) Patent No.: US 7,066,795 B2
(45) Date of Patent: Jun. 27, 2006

(54) POLISHING PAD CONDITIONER WITH SHAPED ABRASIVE PATTERNS AND CHANNELS

(75) Inventors: Venkata R. Balagani, Gilroy, CA (US); George Lazari, San Jose, CA (US); Kenny King-Tai Ngan, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/962,890

(22) Filed: Oct. 12, 2004

(65) Prior Publication Data

US 2006/0079160 A1 Apr. 13, 2006

(51) Int. Cl.
*B24B 21/18* (2006.01)

(52) U.S. Cl. ..... 451/285; 451/443; 451/444; 451/548

(58) Field of Classification Search ..... 451/285, 451/286, 287, 288, 57, 443, 444, 527, 529, 451/548

See application file for complete search history.

(56) References Cited

U.S. PATENT DOCUMENTS

| | | | | |
|---|---|---|---|---|
| 3,743,489 | A | 7/1973 | Wentorf et al. | |
| 3,767,371 | A | 10/1973 | Wentorf, Jr. et al. | |
| 5,190,568 | A * | 3/1993 | Tselesin | 51/293 |
| 5,297,364 | A * | 3/1994 | Tuttle | 451/527 |
| 5,626,509 | A * | 5/1997 | Hayashi | 451/285 |
| 5,782,682 | A * | 7/1998 | Han et al. | 451/548 |
| 6,159,087 | A | 12/2000 | Birang et al. | |
| 6,200,199 | B1 | 3/2001 | Gurusamy et al. | |
| 6,200,207 | B1 * | 3/2001 | Hsu | 451/443 |
| 6,213,856 | B1 * | 4/2001 | Cho et al. | 451/443 |
| 6,322,427 | B1 | 11/2001 | Li et al. | |
| 6,325,709 | B1 | 12/2001 | Nanda et al. | |
| 6,361,423 | B1 | 3/2002 | Gurusamy et al. | |
| 6,540,597 | B1 * | 4/2003 | Ohmori | 451/443 |
| 6,551,176 | B1 | 4/2003 | Garretson et al. | |
| 6,632,127 | B1 | 10/2003 | Zimmer et al. | |
| 6,712,678 | B1 * | 3/2004 | Wada et al. | 451/285 |
| 2003/0114094 | A1 * | 6/2003 | Myoung et al. | 451/443 |
| 2004/0203325 | A1 * | 10/2004 | Donohue | 451/56 |

OTHER PUBLICATIONS

U.S. Application entitled, "Polishing Pad Conditioner and Methods of Manufacture and Recycling"; filed Jul. 8, 2004; Appl. No. 10/888,941; Inventors: Doan, et al.

* cited by examiner

*Primary Examiner*—Jacob K. Ackun, Jr.
(74) *Attorney, Agent, or Firm*—Janah & Associates

(57) ABSTRACT

A polishing pad conditioner comprises a base and a pad conditioning face on the base. The conditioning face comprises central and peripheral regions. Abrasive spokes having a substantially constant width of abrasive particles, extend from the central to the peripheral region. The spokes are symmetric and radially spaced apart from one another, and may have a variety of shapes. The conditioning face can also have a cutout inlet channel to receive polishing slurry when the conditioning face is rubbed against a polishing pad, a conduit to receive the polishing slurry from the cutout inlet channel, and an outlet on the peripheral edge of the base to discharge the received polishing slurry.

25 Claims, 11 Drawing Sheets

POLISHING PAD CONDITIONER WITH SHAPED ABRASIVE PATTERNS AND CHANNELS

BACKGROUND

Embodiments of the present invention relate to a pad conditioner for conditioning chemical-mechanical polishing pads.

Chemical-mechanical planarization (CMP) is used to smooth the surface topography of a substrate, in the manufacture of the integrated circuits and displays, for subsequent etching and deposition processes. A typical CMP apparatus comprises a polishing head that oscillates and presses a substrate against a polishing pad while an abrasive particle slurry is supplied therebetween to polish the substrate. CMP can be used to form a planar surface on dielectric layers, deep or shallow trenches filled with polysilicon or silicon oxide, metal films, and other layers. It is believed that CMP polishing typically occurs as a result of both chemical and mechanical effects, for example, a chemically altered layer is repeatedly formed at the surface of the material being polished and then polished away. For instance, in metal polishing, a metal oxide layer is formed and removed repeatedly from the surface of the metal layer being polished.

During CMP processes, the polishing pad 20 is periodically conditioned by a pad conditioner 24. After the polishing of a number of substrates, the polishing pad 20 becomes glazed with a smoother polishing surface resulting from entangled fibers 26, and accumulated or entrapped polishing residue 28 that clog up the spaces 30 between the fibers of the pad 20, as shown illustrated in FIGS. 1A and 1B. The resultant glazed pad 20 does not effectively retain polishing slurry and can result in increased defects and in certain cases can also lead to non-uniform polishing of a substrate. To remedy pad glazing, the pad 20 is periodically conditioned by a pad conditioner 24 having a conditioning face 32 with abrasive particles 34, such as diamond particles, which is pressed against the used polishing surface 38 of the polishing pad 20, as shown in FIG. 2. The pad conditioner 24 is mounted on an arm 36 that oscillates back and forth as shown by the second position of the dotted arm 36*a*, while the conditioner 24 is rotated against the pad surface to condition the pad 20 by removing polishing debris, unclogging pores and fibers on the polishing surface 38, and sometimes also forming micro-scratches that retain polishing slurry. The pad conditioning process can be carried out during a polishing process—known as in-situ conditioning—or outside of a wafer polishing process known as ex-situ conditioning.

Conventional pad conditioners 24 can be covered with a continuous layer, or pattern strips, of abrasive particles 34. For example, FIG. 3A shows a pad conditioner 24 in which the abrasive particles cover its entire conditioning face 32. A circular strip 40 of abrasive particles along the periphery of the conditioning pad has also been used as shown in FIG. 3B. The circular strip 40 can also be broken into segments 40*a,b* with alternating bands of abrasive particles and smooth regions, as shown in FIG. 3C. In yet another configuration, wedges 42 of abrasive particles 24 are spaced apart from one another and extend tangentially across the conditioning face 32 as shown in FIG. 3D. The abrasive particle patterns can be used to limit the quantity of the diamond bonded area which could limit costs. However, some of these patterns often result in non-uniform and inconsistent pad conditioning effects that can vary across the pad surface. The patterned abrasive pad configurations can also cause slurry to be forced into and entrapped within particular regions of the pad conditioner 24, further reducing the uniformity of pad conditioning.

Conventional pad conditioners 24 can also result in splashing and dried slurry accumulation when they pick-up polishing slurry from the polishing pad surface 38 and randomly expel the slurry from the edges of the pad conditioner 24. For example, as shown in FIG. 2, centrifugal forces generated by the rotating pad conditioner 24 cause the slurry picked-up by the pad conditioner 24 to be ejected along the edges of the pad conditioner as shown by the arrows 44. Slurry depletion from surface of the polishing pad 20 caused by the pad conditioner 24 can cause dry spots on the polishing pad surface, and can result in increased particle defect counts and gross/micro scratching defects.

Accordingly, it is desirable to have a pad conditioner with a conditioning face that provides uniform and repeatable conditioning of polishing pads. It is also desirable to condition a polishing pad without excessive loss of polishing slurry during the conditioning process. It is further desirable to have a pad conditioner with a dispersion of abrasive particles that provides optimal conditioning while controlling the amount of abrasive particles used on the conditioning face.

SUMMARY

In one version, a polishing pad conditioner according to the present invention, comprises a base and a pad conditioning face on the base. The conditioning face comprises central and peripheral regions. Abrasive spokes having a substantially constant width of abrasive particles, extend from the central to the peripheral region. The spokes are symmetric and radially spaced apart from one another.

In another version, the conditioning face comprises a plurality of abrasive arcs that are spaced apart by non-abrasive strips. The abrasive arcs comprise at least a first set of arcs at a first radial distance $R_1$ from the center of the conditioning face, and a second set of arcs at a second radial distance $R_2$ from the center of the conditioning face. The abrasive arcs can have different circumferential lengths.

In yet another version, the conditioning face comprises an array of abrasive squares that are spaced apart from one another and located in a non-abrasive grid. The array alternates non-abrasive regions with abrasive regions to provide a uniform dispersion of abrasive particle squares across the conditioning face.

In a further version, the pad conditioning face comprises at least one cutout inlet channel to receive polishing slurry when the conditioning face is rubbed against a polishing pad. A conduit receives the polishing slurry from the cutout inlet channel. An outlet on the peripheral edge of the base is provided to discharge the received polishing slurry. This version allows recycling of the polishing slurry to conserve the slurry.

DRAWINGS

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

DESCRIPTION

Figure 1A:
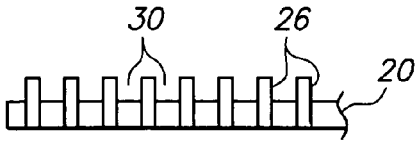
FIG. 1A PRIOR ART
FIG. 1A (PRIOR ART) is a partial sectional side view of a polishing pad in a roughened condition with upright fibers.
Figure 1B:
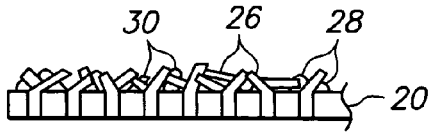
FIG. 1B (PRIOR ART) shows the polishing pad of FIG. 1A after the pad is used and becomes glazed with matted fibers and clogged with waste particulates.
Figure 2:
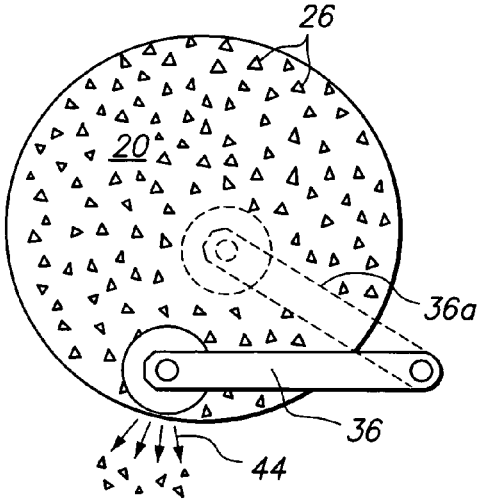
FIG. 2 PRIOR ART
FIG. 2 (PRIOR ART) is a top view of a conditioner arm and pad conditioner assembly conditioning a polishing pad.
Figure 3A:
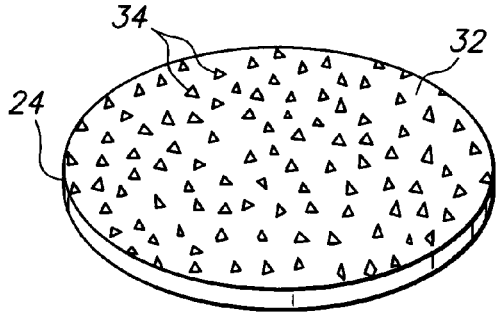
FIG. 3A PRIOR ART
FIGS. 3A to 3D (PRIOR ART) are perspective views of pad conditioners having a conditioning face that is covered substantially continuously with abrasive particles (FIG. 3A), has a peripheral ring of abrasive particles (FIG. 3B), has segmented multi-radius arcs of abrasive particles (FIG. 3C), and has segmented wedges of abrasive particles that are oriented tangentially to a inner circle (FIG. 3D).
Figure 3B:
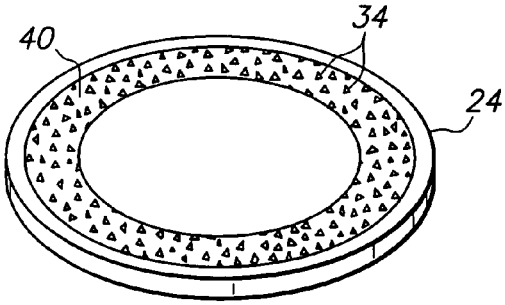
FIG. 3B PRIOR ART
Figure 3C:
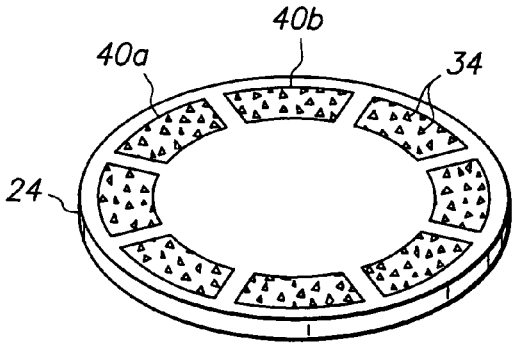
FIG. 3C PRIOR ART
Figure 3D:
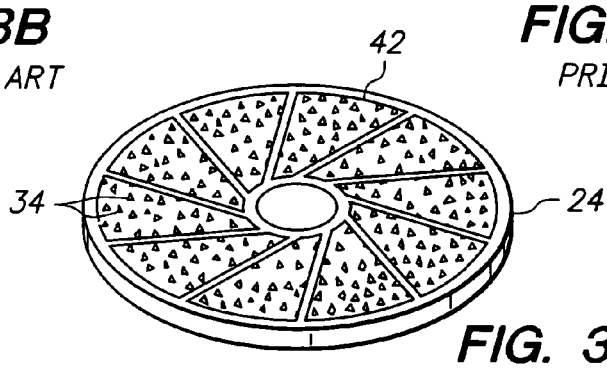
FIG. 3D PRIOR ART

A polishing pad conditioner 50 according to embodiments of the present invention comprises a pad conditioning face 52 with abrasive particles 54 that is rubbed against a polishing pad to condition the pad during chemical-mechanical polishing, as illustrated in FIGS. 4 to 8. The base 58 is a support structure that provides structural rigidity and can be made from steel, or other rigid materials, such as acrylic or aluminum oxide. Generally, the base 58 comprises a planar circular body, like a disc. The base 58 can also include a mechanism for holding the pad conditioner 50 to a CMP polisher, such as two screw holes 62*a,b* countersunk through the conditioning face 52 for screws or bolts to be inserted to hold the base 58 to the polisher; or a locking socket (not shown) centered on a back face 64 of the base 58. While illustrative embodiments of the pad conditioner 50 are described herein, it should be understood that other embodiments are also possible, and thus the scope of the claims should not be limited to these illustrative embodiments.

Figure 8:
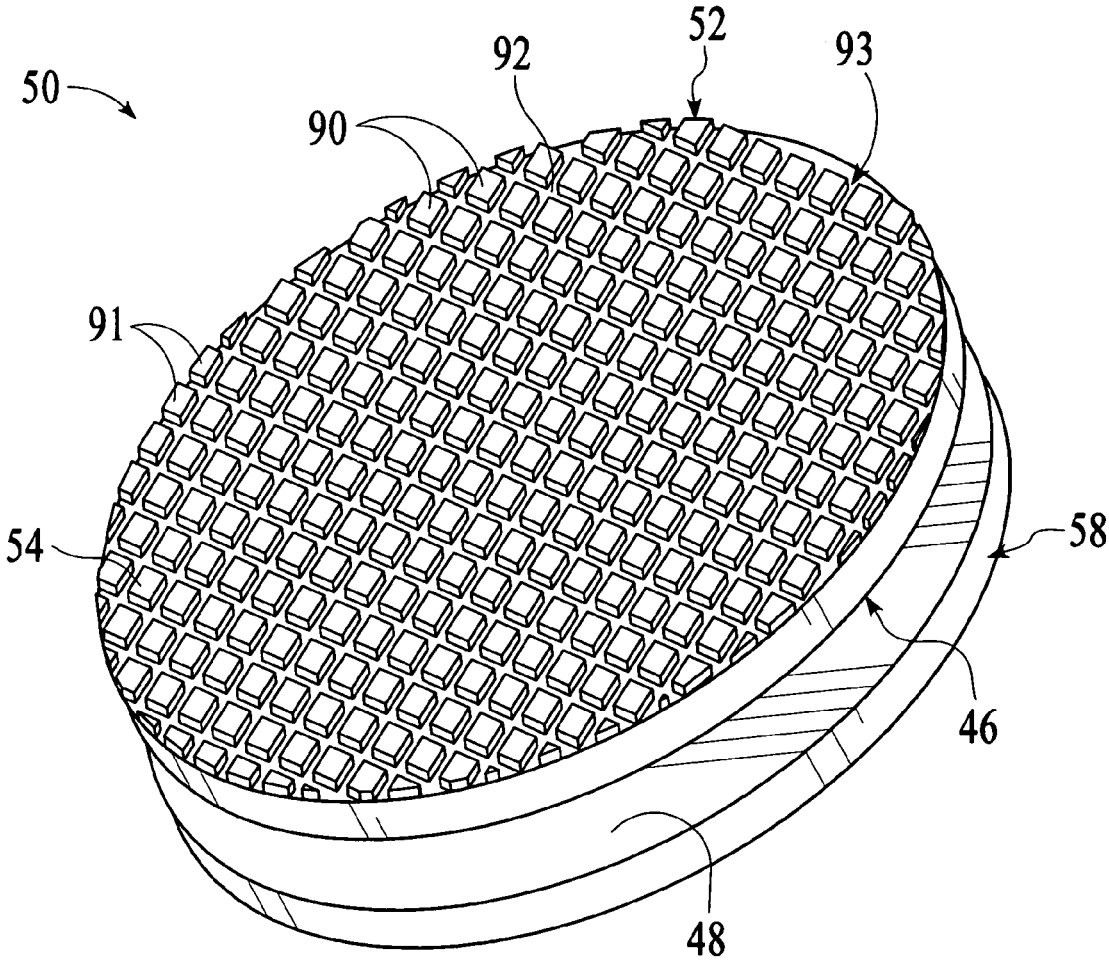
FIG. 8 is a perspective view of a pad conditioner having a conditioning face comprising an array of abrasive squares that are spaced apart from one another and located in a non-abrasive grid.

The conditioning face 52 can be a front surface of the base 58, or formed on a separate structure, such as a disc with a front face with the abrasive particles 54 and a back face that serves as a bond face 46 as illustrated in FIG. 8. The bond face 46 is typically relatively smooth or slightly roughened with grooves (not shown) so that it can be bonded to a receiving face 48 of the base 58 to form a secure bond that will not easily dislodge or loosen from strong frictional forces that are generated when the pad conditioner 50 is pressed against a polishing pad during CMP polishing. The bond face 46 can be adhered to the receiving face 48 of the base 58 with epoxy glue or with a brazing alloy, such as a nickel alloy.

In one version, the conditioning face 52 comprises a matrix material that supports and holds the abrasive particles 54. For example, the matrix material can be a metal alloy, such as a nickel or cobalt alloy, which is coated in a desired pattern on the conditioning face 52, and subsequently, abrasive particles 54 are embedded in the heat softened coating. In another version, abrasive particles 54 are initially positioned on the front conditioning face 52 of the base 58, and thereafter, an alloy material is infiltrated between the abrasive particles 54 in a high temperature, high-pressure fabrication process, to form a conditioning face 52 that forms a unitary structure with the base 58. In another version, the matrix can also be a mesh in which the abrasive particles 54 are embedded to fix their positions relative to one another along the X-Y plane of the grid, as for example, described in commonly assigned U.S. Pat. No. 6,159,087 to Birang et al, which is incorporated herein by reference in its entirety. The mesh may be a wire mesh, such as a nickel wire, or a polymer string mesh.

The abrasive particles 54 are selected of a material that has a hardness value that is higher than the hardness of the material of the polishing pad or polishing slurry particles. A suitable hardness of the abrasive particles is at least about 6 and more preferably 8 Mohrs. Commonly used abrasive particles 54 include diamond crystals, which may be industrially grown. For example, the conditioning face 52 can comprise regions with at least about 60% by volume of diamond, or even at least about 90% by volume of diamond, with the remainder composed of the supporting matrix around the particles 54. The abrasive particles 54 can also be a hard phase of boron carbide crystals, such as a cubic or hexagonal structure, as for example, taught by U.S. Pat. Nos. 3,743,489 and 3,767,371—both of which are incorporated by reference herein in their entireties.

Typically, the abrasive particles 54 are selected by size, such a grit size, or weight, to provide a desired level of roughness of the conditioning face 52. The abrasive particles 54 can also be sorted by shape, that is, particles 54 having relatively sharp contours or crystal cleavage faces versus particles having relatively smooth contours. The abrasive particles 54 can also be selected to have a crystalline structure with substantially the same crystal symmetry about an axis or cross-sectional plane though the particle, as for example, described in commonly assigned patent application Ser. No. 10/888,941, which was filed on Jul. 8, 2004, and which is incorporated by reference herein in its entirety.

The abrasive particles 54 are selected so that at least about 80%, and more preferably, at least about 90% of the particles 54 have the same crystal symmetry. Each symmetric particle 54 is individually positioned, for example, in spaces between a mesh (not shown) to orient them so that an axis of symmetry points toward a particular direction, for example, perpendicular to the plane of the conditioning face 52. The conditioning face 52 of the pad conditioner 50 can also be formed by embedding or encapsulating the abrasive particles 54, such as the symmetric diamond particles in metal coating formed on selected regions of the surface of the base 58. For example, a nickel encapsulant can be first mixed with the selected symmetric diamond particles and then applied only on the desired regions of the front face of the base 58. A suitable metal is a brazing alloy and other metals and alloys used in bonding techniques such as diffusion bonding, hot pressing, resistance welding and the like. A brazing alloy includes low melting point metal components that reduce the melting temperature of the metal alloy to a melting temperature that is typically less than about 400° C. and below the melting temperature of the base to which the conditioning face is being joined. Suitable brazing alloys include nickel based alloys.

Figure 4:
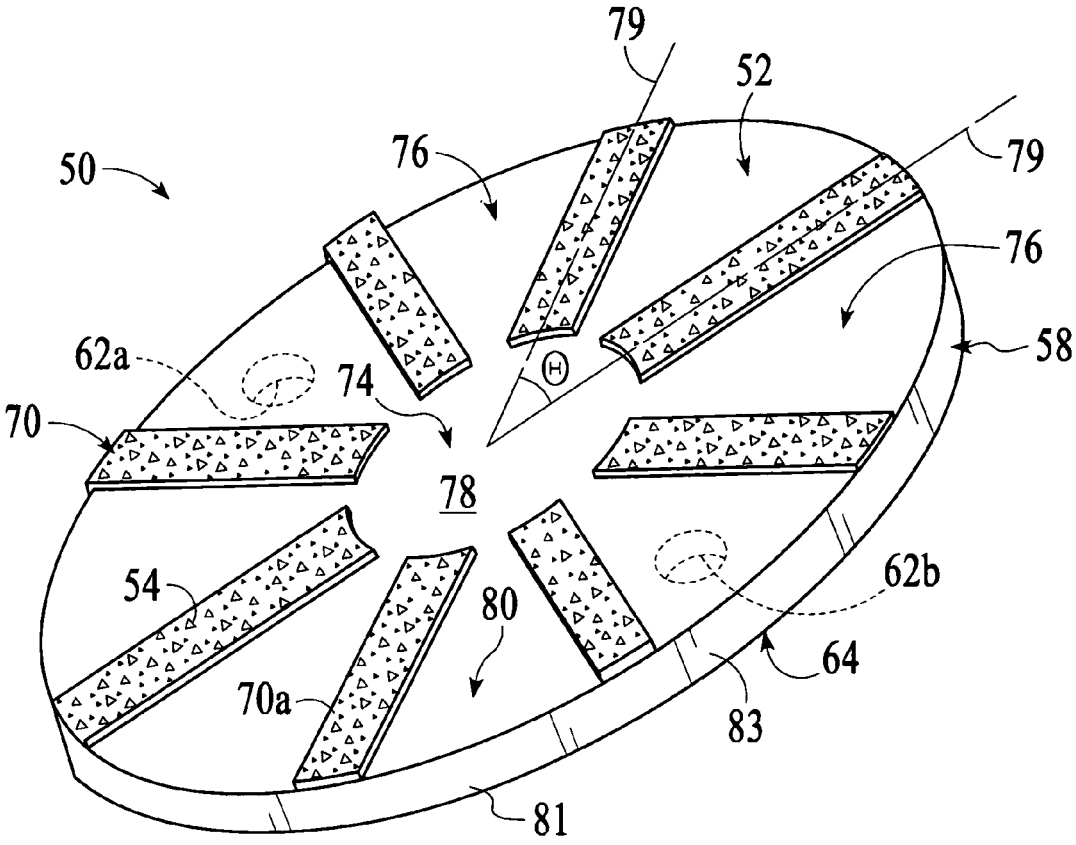
FIG. 4 is a perspective view of a pad conditioner having a conditioning face with abrasive spokes comprising straight legs of abrasive particles radially spaced apart from one another.

Embodiments of the present pad conditioner 50 are designed to provide an optimal combination of properties, such as uniformity of pad conditioning, consistent pad abrasion rates, and optionally, less wastage of slurry. This is accomplished by unique designs of the abrasive regions of the conditioning face 52 of the pad 50. For example, in one version, the pad conditioner 50 comprises a conditioning face 52 with abrasive spokes 70 with a leg having a substantially constant width of abrasive particles that extends from a central region 74 to a peripheral region 76 of the conditioning face 52, as shown in FIG. 4. The spokes 70 are symmetric and radially spaced apart from one another and extend outward from an inner circle 78 on the conditioning face 52 that is absent abrasive particles. The abrasive spokes 70 and non-abrasive regions 80 between the spokes 70 are selected to originate from the inner circle 78 to prevent spokes 70 from intersecting each other to block the slurry flow region or the non-abrasive region 80. The spokes 70 can extend beyond the conditioning face 52 to wrap upwards around the sidewall 81 of the base 58. The sidewall extension 83 provides more uniform conditioning that extends right up to the edge of the conditioning pad.

In one embodiment, the spokes 70 are straight legs 70*a* that are spaced apart and extend radially outward from the inner circle 78. For example, a central axis 79 of each straight leg spoke 70*a* can be separated by an angle θ of 15 to 45 degrees, to provide from about 6 to about 20 spokes, across the total angular range of 360 degrees of the conditioning face. The straight leg spokes 70*a* are separated by non-abrasive wedge regions 80 that are smooth and absent abrasive particles. The straight leg spokes 70*a* of abrasive particles and non-abrasive wedges 80 are advantageous because together they create channels which directs the slurry flow outward.

Figure 6:
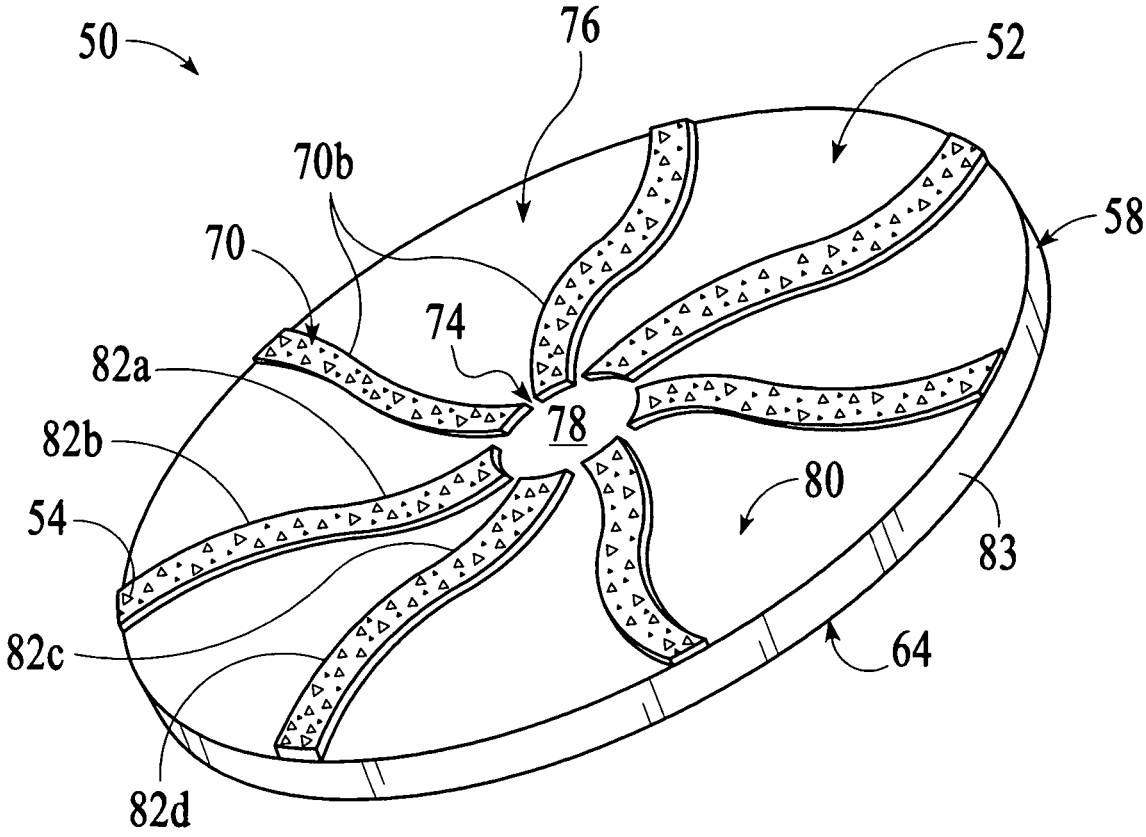
FIG. 6 is a perspective view of a pad conditioner having a conditioning face with abrasive spokes comprising S-shaped legs of abrasive particles extending radially outward from an inner circle.
Figure 7:
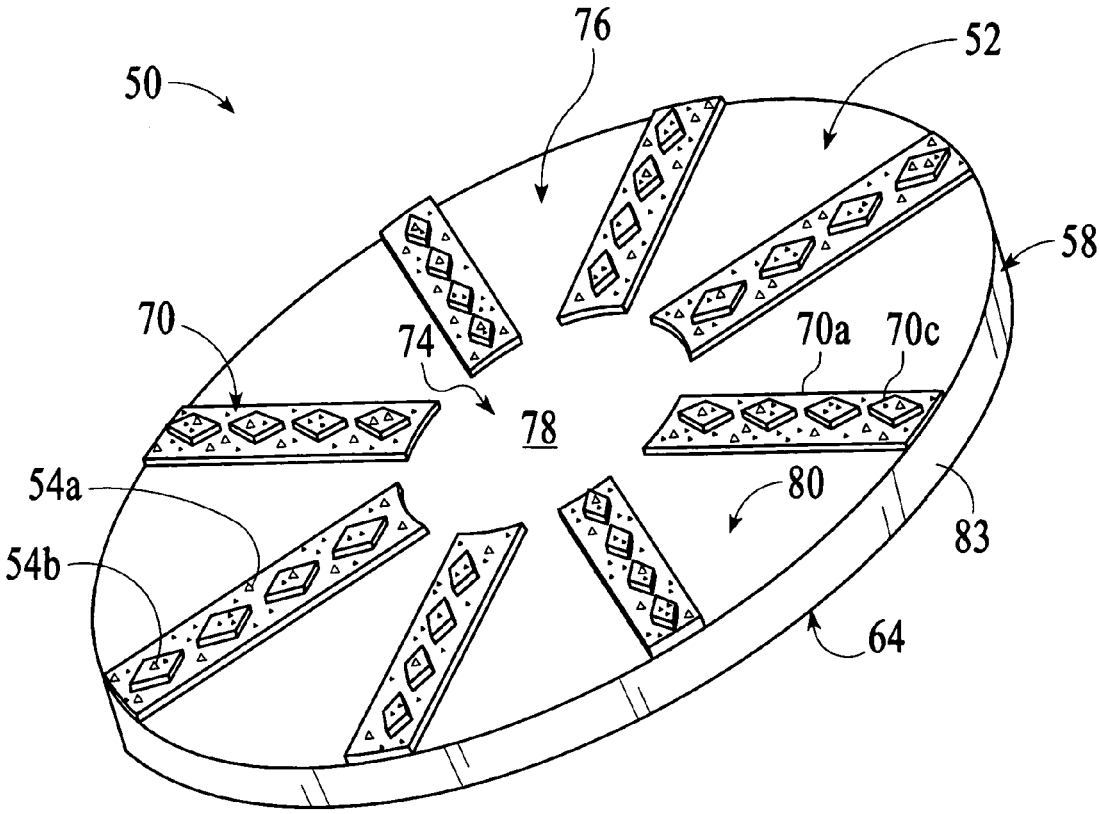
FIG. 7 is a perspective view of a pad conditioner having a conditioning face with abrasive spokes comprising straight legs of abrasive particles with tetrahedrons of second abrasive particles thereon.

In another embodiment, the spokes 70 form S-shaped legs 70*b* that sinuously curve across the surface of the conditioning face forming at least two arcuate shapes 82*a,b*, a version of which is illustrated in FIG. 6. Adjacent S-shaped legs 70*b* are arranged so that their arcuate shapes 82*a,b* and 82*c,d* respectively, trace the same S-shape across the conditioning face 52. The S-shaped legs 70*b* are advantageous because the distance the slurry travels outward, has been increased, hence keeping the slurry under the conditioning process for a longer period of time. In a further embodiment, the spokes 70 further comprise tetrahedrons 70*c* that form second abrasive regions superimposed on an abrasive straight leg 70*a*. The spokes can have first abrasive particles 54*a*, and the tetrahedrons 70*c* have a second and different type of abrasive particle 54*b*, or they can be both formed from the same type of abrasive particles but with different aerial densities, sizes, or shapes.

Figure 5:
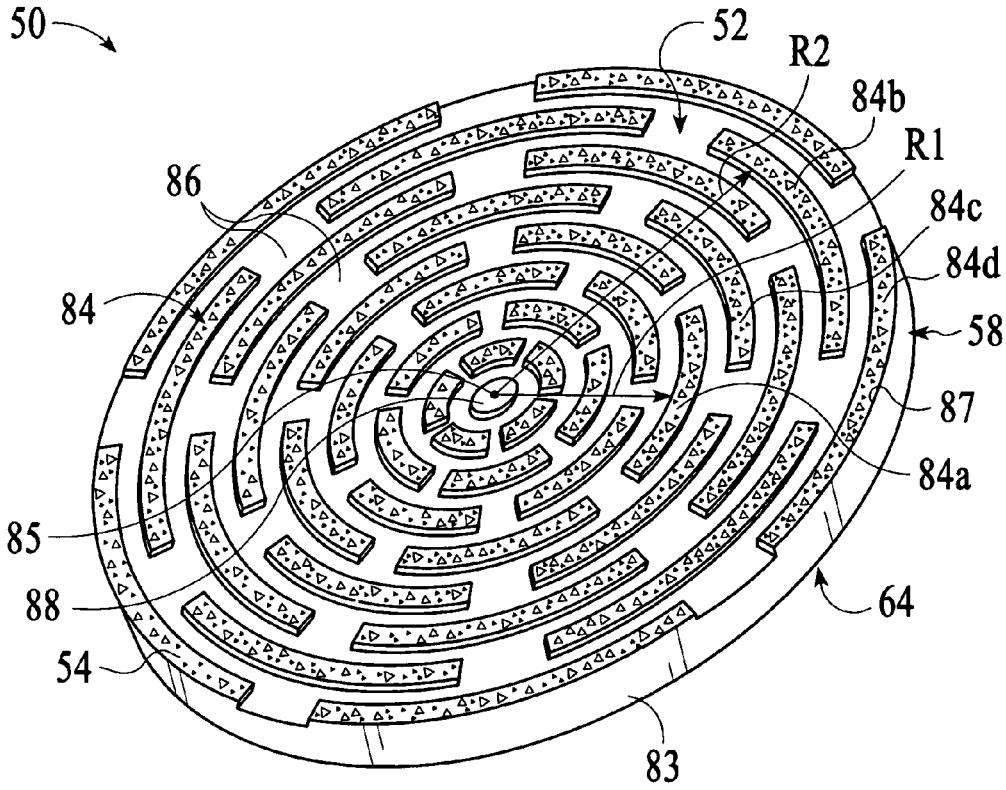
FIG. 5 is a perspective view of a pad conditioner having a conditioning face with spaced apart abrasive arcs that are located at different radial distances.

In another version, the conditioning face comprises a plurality of abrasive arcs 84 having given widths and that are spaced apart by non-abrasive arcuate strips 86, a version of which is illustrated in FIG. 5. The abrasive arcs 84 comprise at least a first set of arcs 84*a* at a first radial distance $R_1$ from the center 85 of the conditioning face, and a second set of arcs 84*b* at a second radial distance $R_2$ from the center 85 of the conditioning face 52 and closer to the perimeter 87 of the conditioning face 52. The distance $R_1$ can be from about 6.35 mm (0.25") to about 25.4 mm (1"); and the distance $R_2$ can be from about 50.8 mm (2") to about 101.6 mm (4"). Preferably, the conditioning face 52 comprises more than just two sets of arcs, for example, a series of sets of abrasive arcs 84*a–d* that are each at a different radius from the center 85 of the conditioning face 52, as shown. For example, the arcs 84 could be separated by a ΔR of 0.125 R, where R is the radius of the conditioning face. So for a conditioning face 52 with a radius of R of from about 44.45 mm (1.75") to about 57.15 mm (2.25"), a suitable ΔR is from about 3.175 mm (0.125") to about 12.7 mm (0.5"). As one example, a conditioning face 52 having a radius of 57.15 mm (2.25") could have 9 abrasive arcs 84 across the radial distance from the center to the perimeter of the conditioning face 52.

Each of the abrasive arcs 84 can also have different circumferential lengths, by which it is meant the length of the outer circumference of the abrasive arc 84. The inner circumference of the arc 84 is a radial function of the outer circumference. For example, referring to FIG. 5, the center 85 of the conditioning face 52 has an abrasive circle 88, which is surrounded by abrasive arcs 84*a–d* with circumferential lengths that gradually increase in size with radial distance from the center of the conditioning face 52. The increasing sized arcs are advantageous because the increasing distance from the center generates higher centrifugal forces, which in turn causes larger amounts of slurry to be concentrated in the outward areas, hence by increasing the arc size, a greater barrier is provided to hold the slurry under the conditioning surface, and this provides superior conditioning of polishing pads.

In another version, the conditioning face 52 comprising an array of abrasive polyhedron 90 which are spaced apart from one another and located in a non-abrasive grid 92. The grid 92 has intersecting lines 93 of non-abrasive material that define the abrasive polyhedron 90. For example, the polyhedron 90 can be rectangles having sides that are at right angles to one another, parallelograms with parallel sides, or even structures with more than four sides, such as pentagons. In one version, the non-abrasive intersecting lines 93 of the grid 92, which are absent abrasive material, are equally spaced apart in both the X and Y plane to define a square grid with square spaces between the non-abrasive network. Each abrasive square 91 is covered with abrasive particles 54 to form an array of abrasive squares 91 that are spaced apart from one another and located in a non-abrasive grid. Each square 91 can be sized, for example, from about 2.54 mm (0.1") to about 25.4 mm (1"); for a conditioning face having a surface area of about 54.516 sq mm (0.1 sq").

The described versions of the pad conditioner 50 provide more uniform cleaning and conditioning of a polishing pad by providing patterned abrasive regions that are tailored in shape and size to optimize conditioning of a polishing pad. The patterned abrasive regions are interspersed with non-abrasive regions, the combination working synergistically and with optimized shapes to provide better pad conditioning. In the described version, the pad conditioner 50 has symmetrically positioned abrasive regions with predefined periodic spacing that provide more uniform and consistent abrasion of a polishing pad. When the conditioning face 52 is pressed against and oscillated across the surface of a polishing pad, the pad is abraded along multiple directions to provide better and more uniform conditioning of the polishing pad. Also, the patterned regions are selected to be consistent in shape and size, with less likelihood of variations in abrasive regions from one conditioning pad to another, to further improve conditioning of a polishing pad.

Figure 9A:
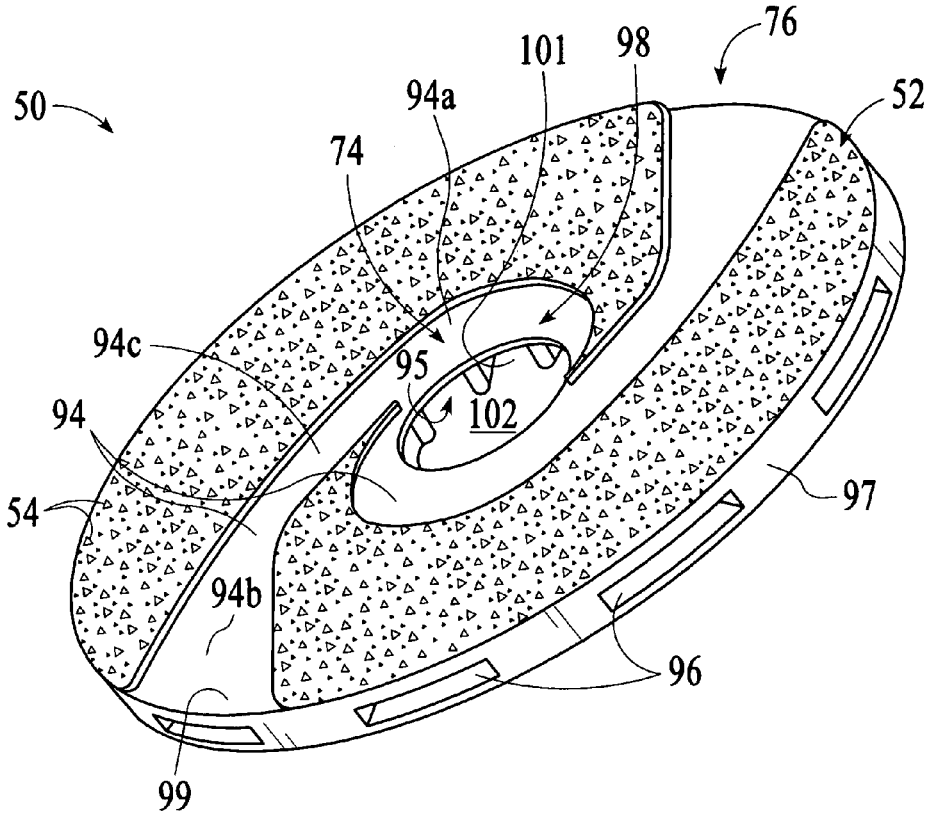
FIG. 9A is a perspective view of a pad conditioner comprising a conditioning face with cutout inlet channels on a base having conduits to receive polishing slurry from the cutout channels and outlets at its peripheral edge.
Figure 9B:
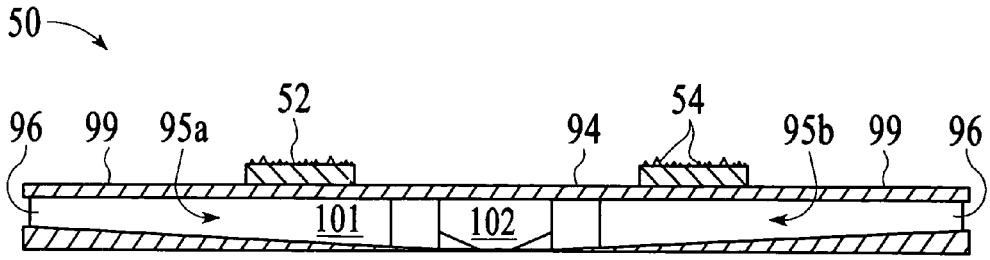
FIG. 9B is a sectional view of a pad conditioner of FIG. 9A showing the cutout inlet channels, conduits, and outlets.
Figure 9C:
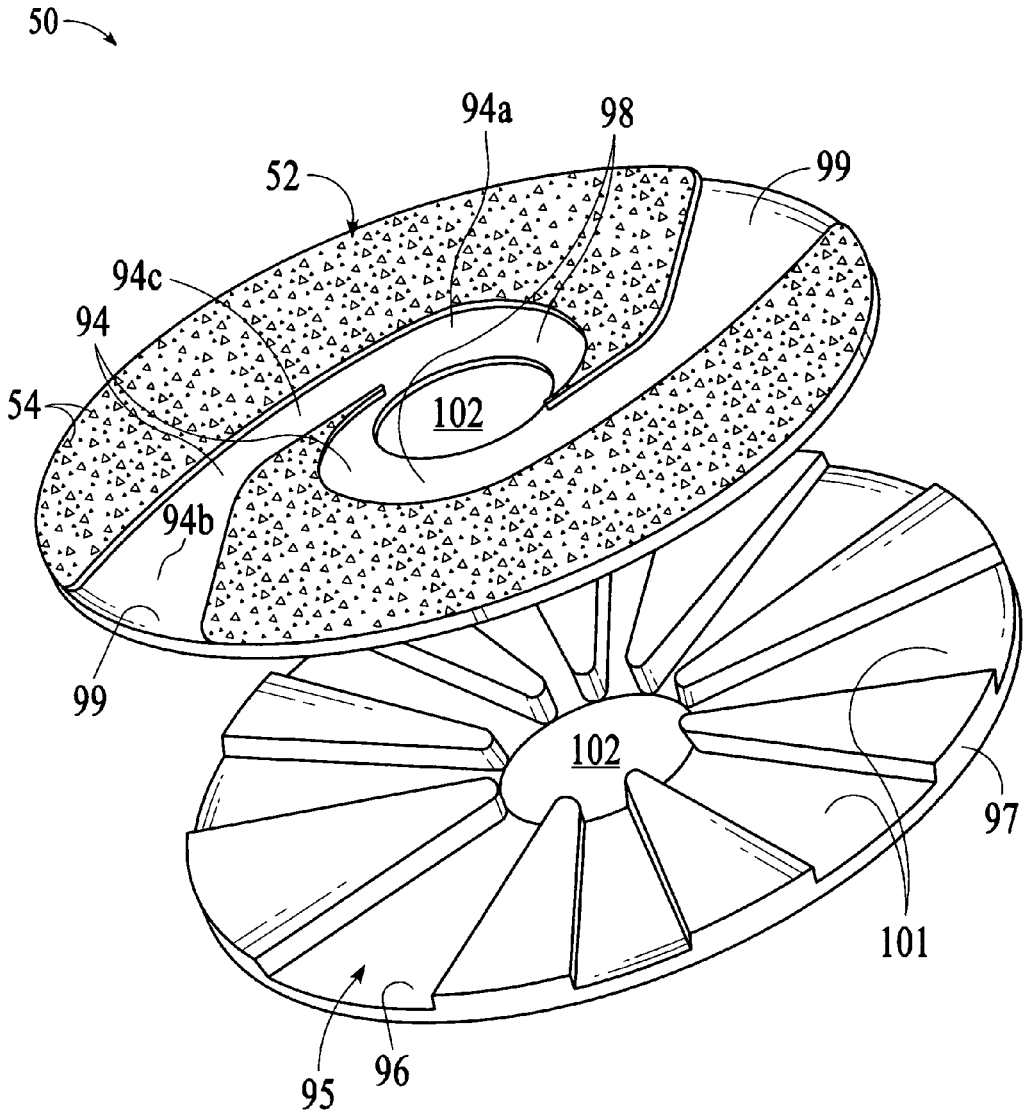
FIG. 9C is a perspective exploded view of the pad conditioner of FIG. 9A, flipped over, showing the conditioning face with cutout inlet channels, and the back face with the conduits and outlets.

In still other versions, the pad conditioner 50 comprises a polishing slurry recycling system which can be used in conjunction with the previously described designs of conditioning pad faces 52 or with other faces 52, such as for example, a conditioning face 52 having a continuous covering surface of abrasive particles 54. This version of the pad conditioner 50, an exemplary embodiment of which is shown in FIGS. 9A to 9C, comprises at least one cutout inlet channel 94 to receive polishing slurry when the conditioning face 52 is rubbed against a polishing pad 20. The cutout inlet channel 94 is contoured to efficiently retrieve polishing slurry from the surface of the polishing pad 20. For example, in the version shown, the cutout inlet channel 94 is contoured with a tapering inner section 94*a* having a first width about a central region 74 of the base 58 and an outer section 94*b* having a second width about a peripheral region 76 of the base 58, the second width being larger than the first width. The larger width of the outer section 94*b* the channel 94 serves to scoop up a large amount of the polishing slurry, which is then directed inward toward the central inlet 102; and the inner section 94*a* with the smaller width serves to speed up the ingoing slurry, which is to be forced into the central inlet 102. In one version, as shown, the inner section 94*a* of the cutout inlet channel 94 spirals radially outward from a curved tapered terminus 98 to a mid-section 94*c* that has parallel walls with a constant width, which in turn flare out to form the outer portion 94*b* of the channel 94 with a v-shaped terminus 99 having a radially increasing width. The cutout inlet channel 94 can be a single channel, two channels (as shown) or multiple channels.

At least one conduit 95 is provided in the base 58 to receive the polishing slurry from the cutout inlet channel 94. The conduit 95 extends through the base 58 to form a network of passageways 101 that cut through the base 58. For example, in one version, the conduit 95 comprises a plurality of passageways 101 that radiate out in a star-shape from a central circular bore 102 at the central region 74 of the base. The central circular bore 102 receives polishing slurry from the cutout inlet channel 94 for dispersion to the star shaped passageways 101. The passageways 101 feed one or more outlets 96 on the peripheral edge 97 of the base 58 to discharge the received polishing slurry. The outlets 96 are located at the peripheral edge 97 of the base 58 so that the polishing slurry is recycled to the peripheral edge 97 of the conditioning pad. This allows the polishing slurry to be discharged from the peripheral edge 97 of the pad conditioner 50 and back onto the surface of the underlying polishing pad that is being conditioned. As shown in FIG. 9B, the conduits 95*a,b* extend radially outward from the central bore 102 to opposing ends of the base 58.

Figure 10A:
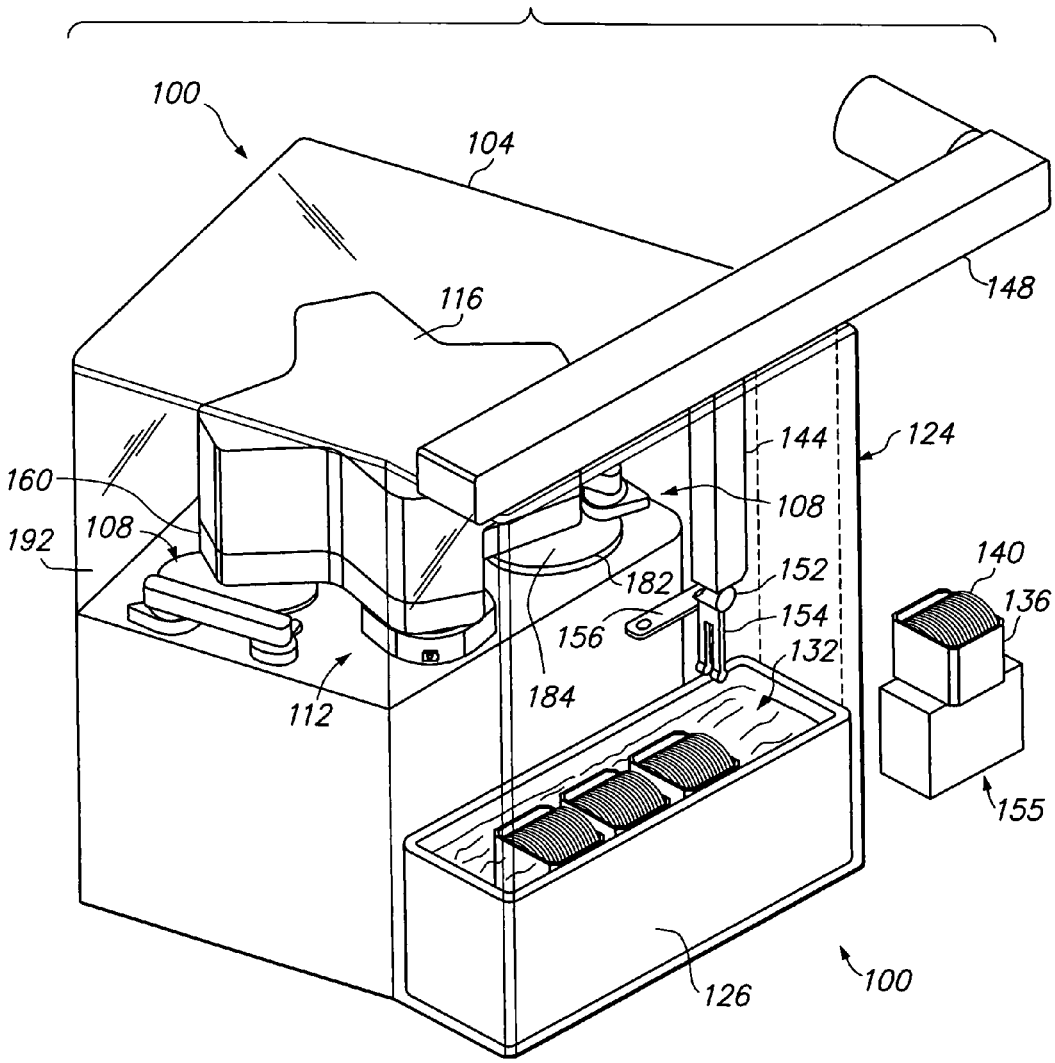
FIG. 10A is a perspective view of a CMP polisher.
Figure 10B:
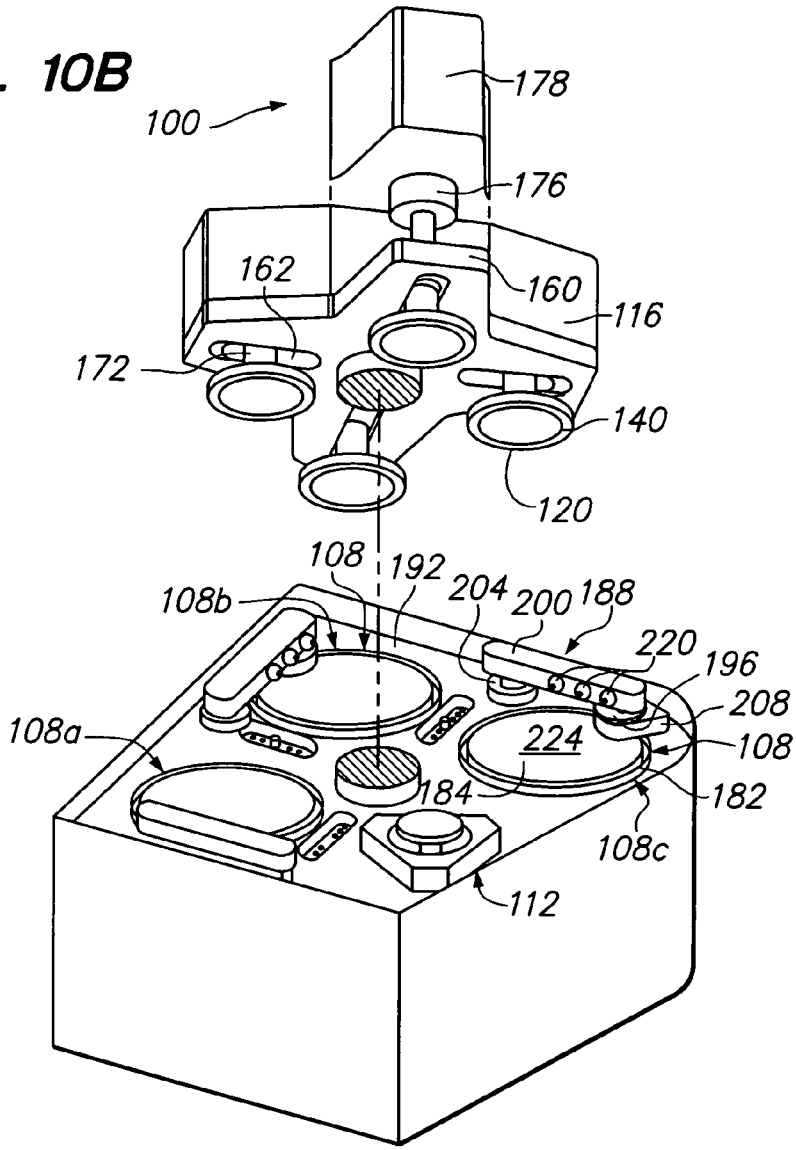
FIG. 10B is a partially exploded perspective view of the CMP polisher of FIG. 10A.
Figure 10C:
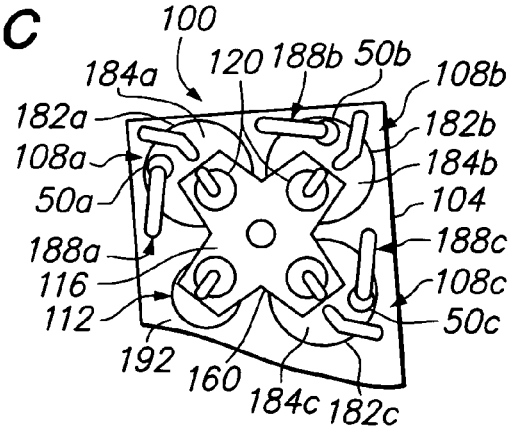
FIG. 10C is a diagrammatic top view of the CMP polisher of FIG. 10B.

The pad conditioner 50 described herein can be used in any type of CMP polisher; thus, the CMP polisher described herein to illustrate use of the pad conditioner 50 should not be used to limit the scope of the present invention. One embodiment of a chemical mechanical polishing (CMP) apparatus 100 capable of using the pad conditioner is illustrated in FIGS. 10A to 10C. Generally, the polishing apparatus 100 includes a housing 104 containing multiple polishing stations 108*a–c*, a substrate transfer station 112, and a rotatable carousel 116 that operates independently rotatable substrate holders 120. A substrate loading apparatus 124 includes a tub 126 that contains a liquid bath 132 in which cassettes 136 containing substrates 140 are immersed, is attached to the housing 104. For example, the tub 126 can include cleaning solution or can even be a megasonic rinsing cleaner that use ultrasonic sound waves to clean the substrate 140 before or after polishing, or even an air or liquid dryers. An arm 144 rides along a linear track 148 and supports a wrist assembly 152, which includes a cassette claw 154 for moving cassettes 136 from a holding station 155 into the tub 126 and a substrate blade 156 for transferring substrates from the tub 126 to the transfer station 112.

The carousel 116 has a support plate 160 with slots 162 through which the shafts 172 of the substrate holders 120 extend, as shown in FIGS. 8A and 8B. The substrate holders 120 can independently rotate and oscillate back-and-forth in the slots 162 to achieve a uniformly polished substrate surface. The substrate holders 120 are rotated by respective motors 176, which are normally hidden behind removable sidewalls 178 of the carousel 116. In operation, a substrate 140 is loaded from the tub 126 to the transfer station 112, from which the substrate is transferred to a substrate holder 120 where it is initially held by vacuum. The carousel 116 then transfers the substrate 140 through a series of one or more polishing stations 108*a–c* and finally returns the polished substrate to the transfer station 112.

Each polishing station 108*a–c* includes a rotatable platen 182*a–c*, which supports a polishing pad 184*a–c*, and a pad conditioning assembly 188*a–c*, as shown in FIG. 8B. The platens 182*a–c* and pad conditioning assemblies 188*a–c* are both mounted to a table top 192 inside the polishing apparatus 100. During polishing, the substrate holder 120 holds, rotates, and presses a substrate 140 against a polishing pad 184*a–c* affixed to the rotating polishing platen 182, which also has a retaining ring encircling the platen 182 to retain a substrate 140 and prevent it from sliding out during polishing of the substrate 140. As a substrate 140 and polishing pad 184*a–c* are rotated against each other, measured amounts of a polishing slurry of, for example, deionized water with colloidal silica or alumina, are supplied according to a selected slurry recipe. Both the platen 182 and the substrate holder 120 can be programmed to rotate at different rotational speeds and directions according to a process recipe.

Each polishing pad 184 typically has multiple layers made of polymers, such as polyurethane, and may include a filler for added dimensional stability, and an outer resilient layer. The polishing pad 184 is consumable and under typical polishing conditions is replaced after about 12 hours of usage. Polishing pads 184 can be hard, incompressible pads used for oxide polishing, soft pads used in other polishing processes, or arrangements of stacked pads. The polishing pad 184 has surface grooves to facilitate distribution of the slurry solution and entrap particles. The polishing pad 184 is usually sized to be at least several times larger than the diameter of a substrate 140, and the substrate is kept off-center on the polishing pad 184 to prevent polishing a non-planar surface onto the substrate 140. Both the substrate 140 and the polishing pad 184 can be simultaneously rotated with their axes of rotation being parallel to one another, but not collinear, to prevent polishing a taper into the substrate. Typical substrates 140 include semiconductor wafers or displays for the electronic flat panels.

Figure 11:
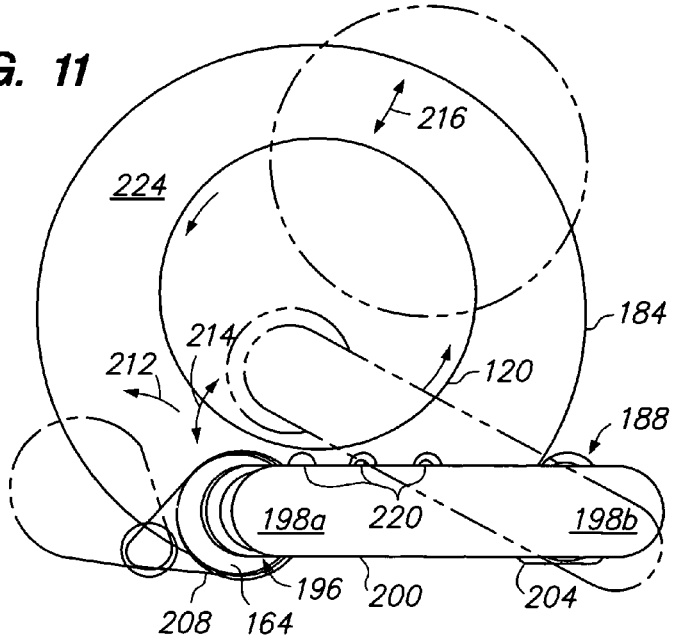
FIG. 11 is a diagrammatic top view of a substrate being polished and a polishing pad being conditioned by the CMP polisher of FIG. 10A.
Figure 12:
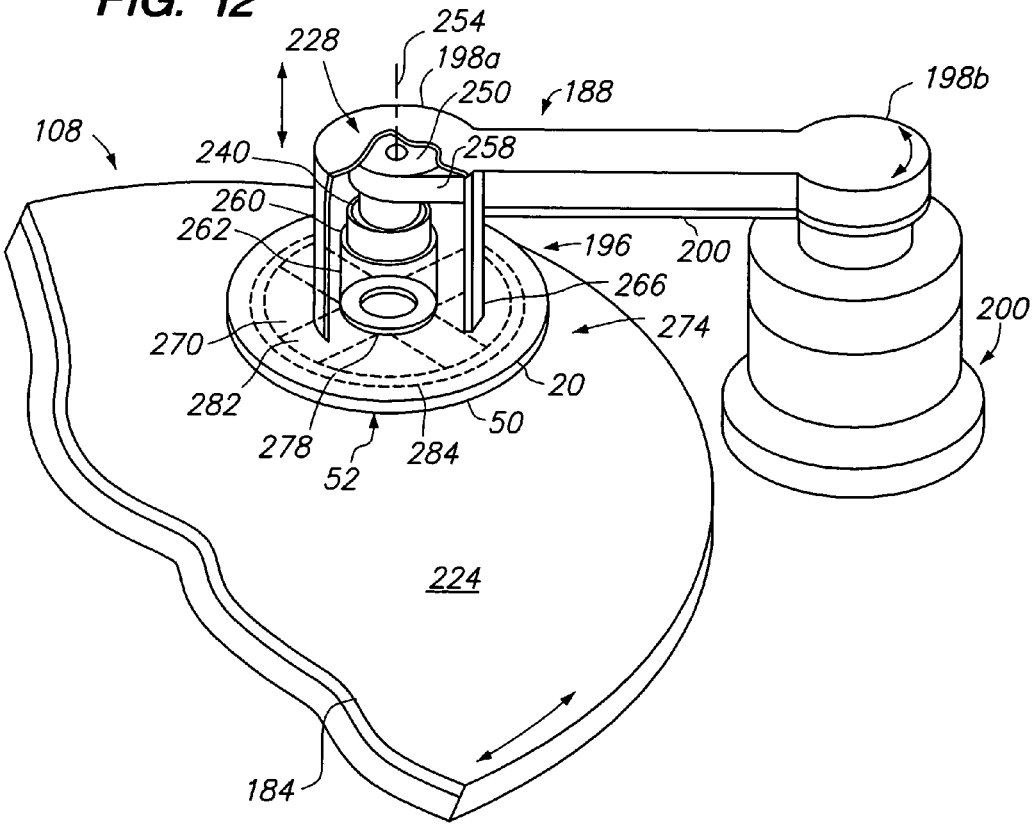
FIG. 12 is a perspective partial cutaway view of a conditioning head assembly of the CMP polisher of FIG. 10A as it is conditioning a polishing pad.

Each pad conditioning assembly 188 of the CMP apparatus 100 includes a conditioner head 196, an arm 200, and a base 204, as shown in FIGS. 11 and 12. A pad conditioner 50 is mounted on the conditioner head 196. The arm 200 has a distal end 198*a* coupled to the conditioner head 196 and a proximal end 198*b* coupled to the base 204, which sweeps the conditioner head 196 across the polishing pad surface 224 so that the conditioning face 52 of the pad conditioner 50 conditions the polishing surface 224 of the polishing pad 184 by abrading the polishing surface to remove contaminants and retexturize the surface. Each polishing station 108 also includes a cup 208, which contains a cleaning liquid for rinsing or cleaning the pad conditioner 50 mounted on the conditioner head 196.

During the polishing process, a polishing pad 184 can be conditioned by a pad conditioning assembly 188 while the polishing pad 184 polishes a substrate mounted on a substrate holder 120. The pad conditioner 50 has an abrasive disc 24 that has an conditioning face 52 with abrasive particles 52 which are used to condition the polishing pad 184. In use, the conditioning face 52 of the disc 24 is pressed against a polishing pad 184, while rotating or moving the pad or disc along an oscillating or translatory pathway. The conditioner head 196 sweeps the pad conditioner 50 across the polishing pad 184 with a reciprocal motion that is synchronized with the motion of the substrate holder 120 across the polishing pad 184. For example, a substrate holder 120 with a substrate to be polished may be positioned in the center of the polishing pad 184 and conditioner head 196 having the pad conditioner 50 may be immersed in the cleaning liquid contained within the cup 208. During polishing, the cup 208 may pivot out of the way as shown by arrow 212, and the pad conditioner 50 of the conditioner head 196 and the substrate holder 120 carrying a substrate may be swept back-and-forth across the polishing pad 184 as shown by arrows 214 and 216, respectively. Three water jets 220 may direct streams of water toward the slowly rotating polishing pad 184 to rinse slurry from the polishing or upper pad surface 224 while a substrate 120 is being transferred back. The typical operation and general features of the polishing apparatus 100 are further described in commonly assigned U.S. Pat. No. 6,200,199 B1, filed Mar. 31$^{st}$, 1998 by Gurusamy et al., which is hereby incorporated by reference herein in its entirety.

Referring to FIG. 12, the conditioner head 196 includes an actuation and drive mechanism 228 that rotates an conditioner head 196 carrying the pad conditioner 50 about a central vertically-oriented longitudinal axis 254 of the head. The actuation and drive mechanism further provides for the movement of the conditioner head 196 and the pad conditioner 50 between an elevated retracted position and a lowered extended position (as shown) in which the conditioning face 52 of the pad conditioner 50 is engaged with the polishing surface 224 of the pad 184. The actuation and drive mechanism 228 includes a vertically-extending drive shaft 240 which may be formed of heat treated 440C stainless steel, and which terminates in an aluminum pulley 250. The pulley 250 is secured carries a belt 258 which extends along the length of the arm 200 and is coupled to a remote motor (not shown) for rotating the shaft 240 about the longitudinal axis 254. A stainless steel collar, having upper and lower pieces 260 and 262, respectively, are coaxial to the drive shaft 240. The shaft, pulley, and collar form a generally rigid structure that rotates as a unit about the longitudinal axis 254. A generally annular drive sleeve 266 of stainless steel couples the conditioner head 196 to the drive shaft 240, and allows the application of a hydraulic pressure or air pressure to the pad conditioner holder 274. The drive shaft 240 transmits torque and rotation from the pulley to the sleeve 266 and a bearing may be interposed therebetween (not shown).

An optional removable pad conditioner holder 274 may intervene between the pad conditioner 50 and the backing plate 270, as shown in FIG. 12. Extending radially outward from a hub 278 are four generally flat sheet-like spokes 282 having distal ends that are secured to an annular rim 284. The spokes 282 are resiliently flexible upward and downward so as to permit tilting of the rim, relative to the axis 254 from the otherwise neutral horizontal orientation, while they substantially inflexible transverse to the axis 254, so that they effectively transmit torque and rotation about the axis 254 from the hub 278 to the rim 284. Below the spokes, the backing plate includes a rigid, generally disc-shaped, polyethylene terepthalate (PET) plate 270 that extends radially outward. A pad conditioner 50 may be mounted on a pad conditioner holder 274 by screws or a cylindrical magnet that is located in a matching cylindrical bore of the holder 274.

In operation, the conditioner head 196 is positioned above the polishing pad 20 as described above, and the drive shaft 240 is rotated causing rotation of pad conditioner 50. The conditioner head 196 is then shifted from the retracted position to an extended position to bring the conditioning face 52 of the pad conditioner 50 into engagement with the polishing surface 224 of the polishing pad 184. The downward force compressing the pad conditioner 50 against the pad 184 may be controlled, for example, by modulating a hydraulic or air pressure applied within the cylinder 266. The downward force is transmitted through the drive sleeve 266, the hub 278, the backing plate 270, to the pad conditioner holder 274, and then to the pad conditioner 50. Torque to rotate the pad conditioner 50 relative to the polishing pad 184 is supplied from the drive shaft 240 to the hub 278, the spokes 282, the rim 284 of the backing plate 270, the pad conditioner holder 274, and then to the pad conditioner 50. The lower surface of the rotating pad conditioner 50, in engagement with the polishing surface of the rotating polishing pad 184, is reciprocated in a path along the rotating polishing pad as described above. During this process, the conditioning face 52 of the pad conditioner 50 is immersed in the thin layer of a polishing slurry atop the polishing pad 184.

For cleaning the pad conditioner 50, the conditioner head is raised, causing the pad conditioner 50 to disengage from the polishing pad. The cup 208 may then be pivoted to a location below the head and the conditioner head 196 extended so as to immerse the pad conditioner 50 in a cleaning liquid in the cup 208. The pad conditioner 50 is rotated about the axis 254 within the body of cleaning liquid (the rotation need not have been altered since the pad conditioner was engaged to the pad). The rotation causes a flow of the cleaning liquid past the pad conditioner 50 to clean the pad conditioner of contaminants including material worn from the pad, byproducts of the polishing etc.

The aforementioned versions of the pad conditioner 50 uniformly roughen the polishing surface 224 of a polishing pad 184 as the surface 224 gradually smoothens from repeated polishing. The pad conditioner 50 also keeps the surface 224 of the pad 184 more level when the pattern of sweep and head pressure causes uneven wear of a polishing pad 184. The surface 224 is maintained smooth by grinding down the high uneven areas of the pad 184. The symmetric abrasive particles 54 of the pad conditioner 50 improve the uniformity of conditioning across the polishing surface 224 of the pad by providing more consistent abrasion rates because of the more uniform shape and symmetry of the abrasive particles 54. The pad conditioners 50 also provide more consistent and reproducible results from one pad conditioner 50 to another since pad conditioners with similar shapes of abrasive particles 54 produce better and more uniform conditioning rates.

The present invention has been described with reference to certain preferred versions thereof; however, other versions are possible. For example, the pad conditioner can be used in other types of applications, as would be apparent to one of ordinary skill, for example, as a sanding surface. Other configurations of the CMP polisher can also be used. Furthermore, alternative channel configurations or abrasive patterns equivalent to those described can also be used in accordance with the parameters of the described implementation, as would be apparent to one of ordinary skill. Therefore, the spirit and scope of the appended claims should not be limited to the description of the preferred versions contained herein.

What is claimed is:

1. A polishing pad conditioner comprising:

(a) a base; and (b) a conditioning face on the base, the conditioning face comprising:

(i) a central region, (ii) a peripheral region, and (iii) a plurality of straight abrasive spokes comprising a substantially constant width of abrasive particles that extend from the central region to the peripheral region, the abrasive spokes each comprising a central axis and being radially spaced apart from one another such that the central axes of adjacent abrasive spokes are separated by an angle of from about 15 to about 45°.

2. A pad conditioner according to claim 1 wherein the abrasive spokes comprise from 6 to 20 spokes.

3. A pad conditioner according to claim 1 wherein the abrasive spokes further comprise tetrahedrons of second abrasive particles.

4. A pad conditioner according to claim 1 comprising non-abrasive wedge regions between the abrasive spokes that are smooth and absent abrasive particles.

5. A pad conditioner according to claim 1 wherein the abrasive spokes extend beyond the surface to wrap upwards around the sidewall of the base.

6. A pad conditioner according to claim 1 wherein the abrasive particles comprise diamond particles.

7. A pad conditioner according to claim 6 wherein at least about 80% of the abrasive particles have crystalline structures with substantially the same crystal symmetry.

8. A chemical mechanical apparatus comprising the pad conditioner of claim 1, and further comprising:

(i) a polishing station comprising a platen to hold a polishing pad, a support to hold a substrate against the polishing pad, a drive to power the platen or support, and a slurry dispenser to dispense slurry on the polishing pad;

(ii) a conditioner head to receive the pad conditioner of claim 1; and (iii) a drive to power the conditioner head so that the conditioning face of the pad conditioner can be rubbed against the polishing pad to condition the pad.

9. A polishing pad conditioner comprising:

(a) a base; and (b) a conditioning face on the base, the conditioning face comprising a plurality of abrasive arcs spaced apart by non-abrasive strips, the abrasive arcs comprising at least a first set of arcs at a first radial distance $R_1$ from the center of the conditioning face, and a second set of arcs at a second radial distance $R_2$ from the center of the conditioning face, the abrasive arcs being separated by a $\Delta R$ of 0.125 R, where R is the radius of the conditioning face.

10. A pad conditioner according to claim 1 wherein $\Delta R$ is from about 3.175 mm (0.125") to about 12.7 mm (0.5").

11. A pad conditioner according to claim 9 wherein the abrasive arcs have different circumferential lengths.

12. A pad conditioner according to claim 9 wherein the circumferential lengths increase with radial distance from the center of the conditioning face.

13. A polishing pad conditioner comprising:

(a) a base; and (b) a conditioning face on the base, the conditioning face comprising an array of abrasive squares that are spaced apart from one another and located in a non-abrasive grid, the abrasive squares comprising abrasive particles such that at least about 80% of the abrasive particles have crystalline structures with substantially the same crystal symmetry.

14. A polishing pad conditioner comprising:

(a) a conditioning face comprising at least one cutout inlet channel to receive polishing slurry when the conditioning face is rubbed against a polishing pad, the cutout inlet channel comprising a mid-section having a constant radial width;

(b) at least one conduit to receive the polishing slurry from the cutout inlet channel; and (c) at least one outlet on the peripheral edge of the base to discharge the received polishing slurry.

15. A pad conditioner according to claim 14 wherein the cutout inlet channel tapers from a first width at a central region of the conditioning face to a second width at the peripheral region of the conditioning face, the second width being larger than the first width.

16. A pad conditioner according to claim 14 wherein at least a portion of the cutout inlet channel spirals radially outward from the central to the peripheral region of the base.

17. A pad conditioner according to claim 14 wherein the cutout inlet channel comprises a v-shaped terminus having a radially increasing width.

18. A pad conditioner according to claim 14 wherein the cutout inlet channel comprises a curved tapered inlet.

19. A pad conditioner according to claim 14 wherein the abrasive particles comprise diamond particles.

20. A polishing pad conditioner comprising:

(a) a base; and (b) a conditioning face on the base, the conditioning face comprising:

(i) a central region, (ii) a peripheral region, and (iii) a plurality of S-shaped abrasive spokes comprising a substantially constant width of abrasive particles that extend from the central region to the peripheral region.

21. A pad conditioner according to claim 20 wherein the abrasive spokes each comprise a central axis and are radially spaced apart from one another such that the central axes of adjacent abrasive spokes are separated by an angle of from about 15 to about 45°.

22. A pad conditioner according to claim 20 wherein the abrasive spokes comprise from 6 to 20 spokes.

23. A pad conditioner according to claim 20 wherein the abrasive particles comprise diamond particles.

24. A pad conditioner according to claim 20 wherein at least about 80% of the abrasive particles have crystalline structures with substantially the same crystal symmetry.

25. A chemical mechanical apparatus comprising the pad conditioner of claim 20, and further comprising:

(i) a polishing station comprising a platen to hold a polishing pad, a support to hold a substrate against the polishing pad, a drive to power the platen or support, and a slurry dispenser to dispense slurry on the polishing pad;

(ii) a conditioner head to receive the pad conditioner of claim 20; and (iii) a drive to power the conditioner head so that the conditioning face of the pad conditioner can be rubbed against the polishing pad to condition the pad.

* * * * *